US007005590B1

(12) United States Patent
Willis

(10) Patent No.: US 7,005,590 B1
(45) Date of Patent: Feb. 28, 2006

(54) ELECTRIC PANEL WITH CIRCUIT BREAKER CONTROL GATE AND CIRCUIT BREAKER CONTROL METHOD

(76) Inventor: Angelo Willis, 8046 American, Detroit, MI (US) 48204

( * ) Notice: Subject to any disclaimer, the term of this patent is extended or adjusted under 35 U.S.C. 154(b) by 73 days.

(21) Appl. No.: 10/748,533

(22) Filed: Dec. 30, 2003

(51) Int. Cl.
*H01H 1/20* (2006.01)
*H01H 9/20* (2006.01)

(52) U.S. Cl. ..... 200/50.32; 200/43.11; 200/43.14; 200/50.33; 361/627

(58) Field of Classification Search .. 200/50.32–50.35, 200/50.3, 43.01, 43.11–43.14, 43.16, 43.19, 200/296; 361/627, 641–644
See application file for complete search history.

(56) References Cited

U.S. PATENT DOCUMENTS 3,312,794 A * 4/1967 Hollyday ..... 200/43.15
3,566,318 A 2/1971 Gelzheiser et al.
5,291,165 A 3/1994 Whipple et al.
5,552,755 A 9/1996 Fello et al.
5,745,337 A 4/1998 Reiner
5,874,698 A * 2/1999 Collis ..... 200/50.33
5,973,914 A 10/1999 Rose et al.
6,031,193 A * 2/2000 Flegel ..... 200/50.33
6,043,439 A * 3/2000 Crooks et al. ..... 200/50.33
6,096,986 A * 8/2000 Flegel ..... 200/50.33
6,266,232 B1 7/2001 Rose et al.
6,469,264 B1 * 10/2002 Benda ..... 200/43.14
6,570,269 B1 5/2003 McMillan et al.
6,617,532 B1 9/2003 Turek
6,649,851 B1 11/2003 Hennel et al.

* cited by examiner

*Primary Examiner*—Richard K. Lee
(74) *Attorney, Agent, or Firm*—Reising, Ethington, Barnes, Kisselle, P.C.

(57) ABSTRACT

The main power service panel is provided with a special sliding gate on the face plate which can be selectively positioned to control the manual throw of adjacent circuit breaker handles for main and auxiliary power inputs fed thereto. The control is such that only one of the two circuit breakers can be conditioned for power transmittal at any one time. Accordingly, primary and auxiliary power supplies can be readily wired to associated main and auxiliary circuit breakers of the main power panel so that distribution circuit breakers of the panel can be energized in the event of failure of one of the power supplies, assuring a supply of power to the discrete distribution circuits. This selected supply to either breaker is accomplished with assurance there will be no back feed of electrical energy to the alternative supply.

4 Claims, 4 Drawing Sheets

ELECTRIC PANEL WITH CIRCUIT BREAKER CONTROL GATE AND CIRCUIT BREAKER CONTROL METHOD

BACKGROUND OF THE INVENTION

Prior to the present invention various electric power panel formats and configurations have been devised so that electrical service can be provided by primary and auxiliary sources to assure energization of the panel distribution circuits. One technique and construction for safely connecting an auxiliary generator to a main power panel to provide stand-by power is through a manual transfer switch in an auxiliary panel. This panel is wired to an adjacent main panel and can be manually set to rout electricity from the municipal power supply or from a stand-by generator to main panel distribution circuits. An example of such construction is disclosed in Popular Mechanics, March 1998, pp 79–82 Another technique and construction involves the employment a special circuit breaker for a main power panel with a signal controlled internal selector. This breaker is operative to receive power from either main or alternate electric power sources and route power to distribution circuits as disclosed in U.S. Pat. No. 6,570,269 issued May 27, 2003 to McMillan et al for Method and Apparatus for Supplying Power to a Load Circuit from Alternate Power Sources.

SUMMARY OF THE INVENTION

While these prior constructions, techniques and systems have meritorious features they are costly, space-consuming, complex and difficult to install and service. Accordingly, new and improved constructions and systems offering straight-forward solutions are needed to replace outmoded systems and old constructions. The present invention responds to and meets these needs with new and improved power panel construction and provides new and higher standards for the economical, assured and consumer selected delivery of utility or auxiliary power to household circuits that is both safe and sound. In this invention available components are uniquely combined into a new and improved assembly to provide a main electric service panel with circuit breaker control gate for primary and auxiliary power sources.

This invention relates to dual input electrical circuit breaker and box assemblies feeding a plurality of discrete power distribution circuits and more particularly to new and improved breaker and breaker box assemblies which can readily accommodate and isolate separate feeds from main and standby power supplies into adjacent circuit breakers. These breakers have manual control handles whose on-off switch movement is limited and controlled by a special gate unit adjustably mounted on the breaker box so that only the main breaker or the stand by breaker can be positioned at an "on" position at any one time. This ensures that there is no back flow of electrical energy into the supply not being utilized.

With this invention new and improved standards are presented with a straight forward construction featuring a minimized number of electrical connections and eliminating auxiliary panels. Moreover a wide range of existing power panels including those in service can be readily modified in accordance with this invention to safely provide for stand-by electric power.

These and other features, objects and advantages will be more apparent from the following specification, claims and drawings in which:

DETAILED DESCRIPTION OF THE PREFERRED EMBODIMENT

Figure 1:
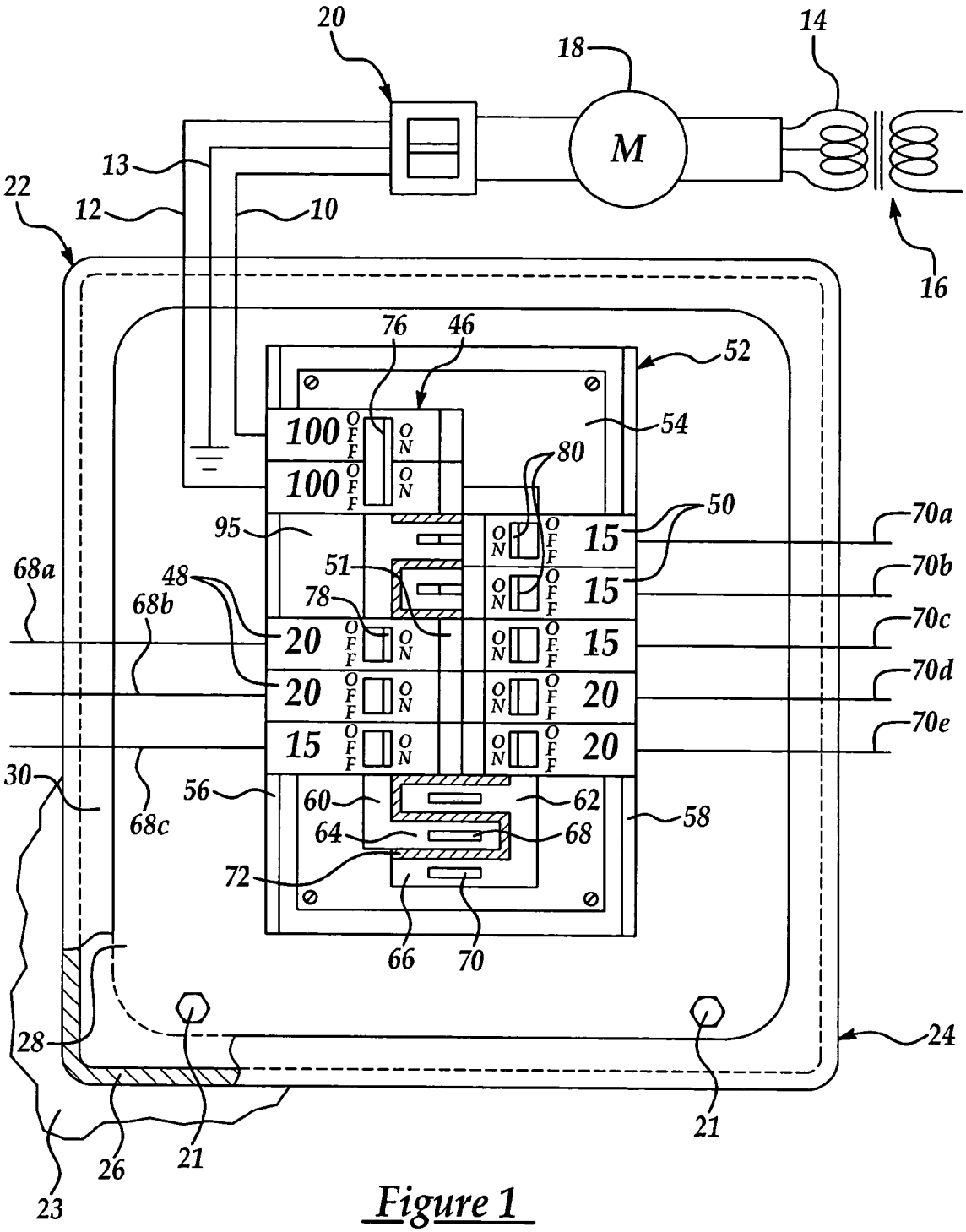
FIG. 1 is a diagrammatic view of a portion of a breaker box being fed by an electrical power source for delivery to discrete power distribution circuits in a building.

Turning now in greater detail to the drawings, FIG. 1 diagrammatically illustrates two 115 volt power feeds 10, 12 and ground 13 routed from a step-down transformer 14 of a main or primary power supply 16 of a utility through a meter 18 and a remote load center 20 to a main electrical supply panel 22. This main panel provides a control center with circuit overload and short circuit protection for a building such as a home and is mounted by fasteners 23 to a suitable support structure. The electrical panel comprises a box-like case 24 formed with a peripheral wall 26 extending upward from a back plate 28 which terminates in an inwardly-extending upper flange 30.

Figure 2:
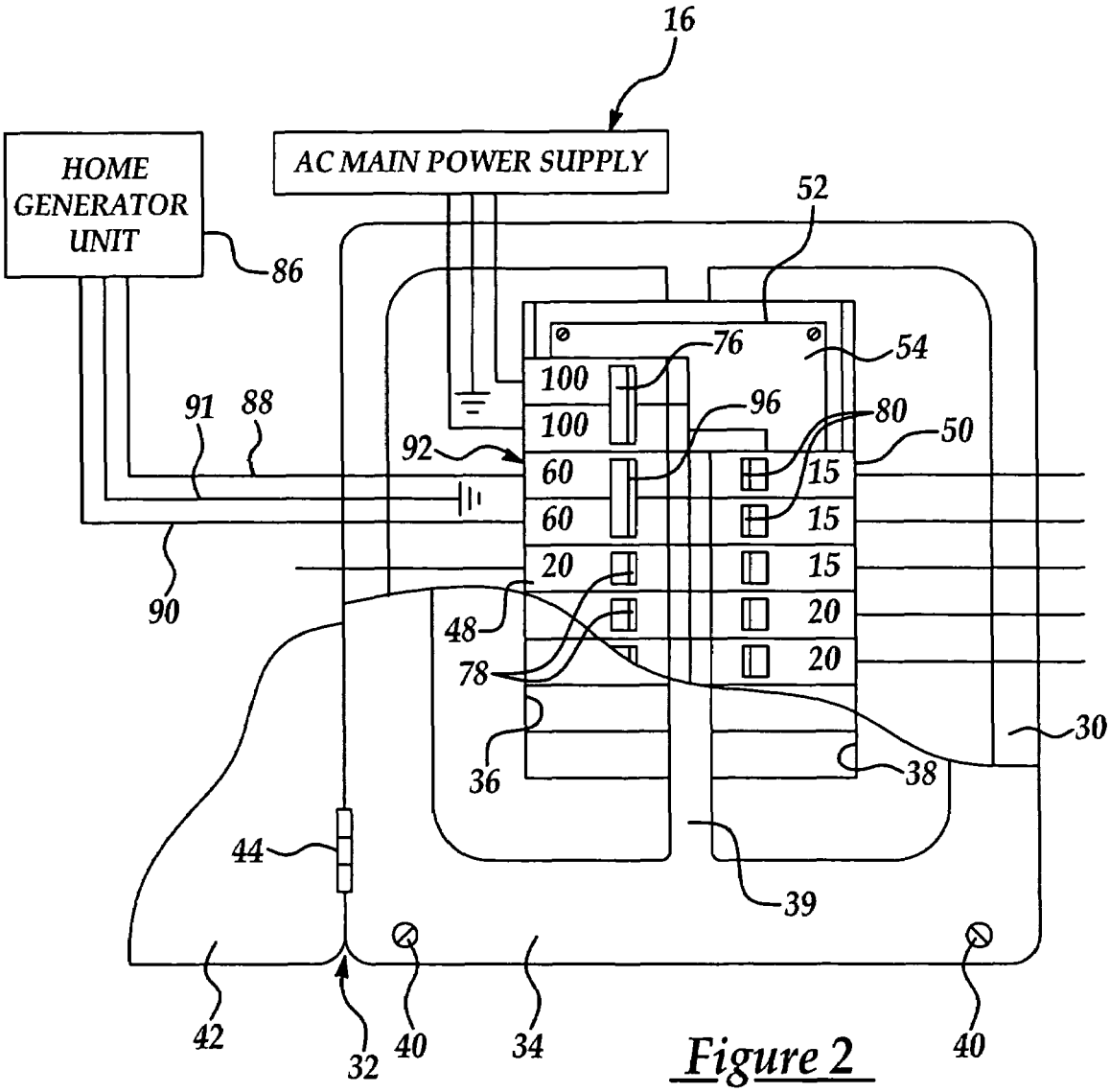
FIG. 2 is a diagrammatic view similar to that of FIG. 1 illustrating an auxiliary power generator unit located exterior of the building and hooked up to the main power panel of the building.
Figure 3:
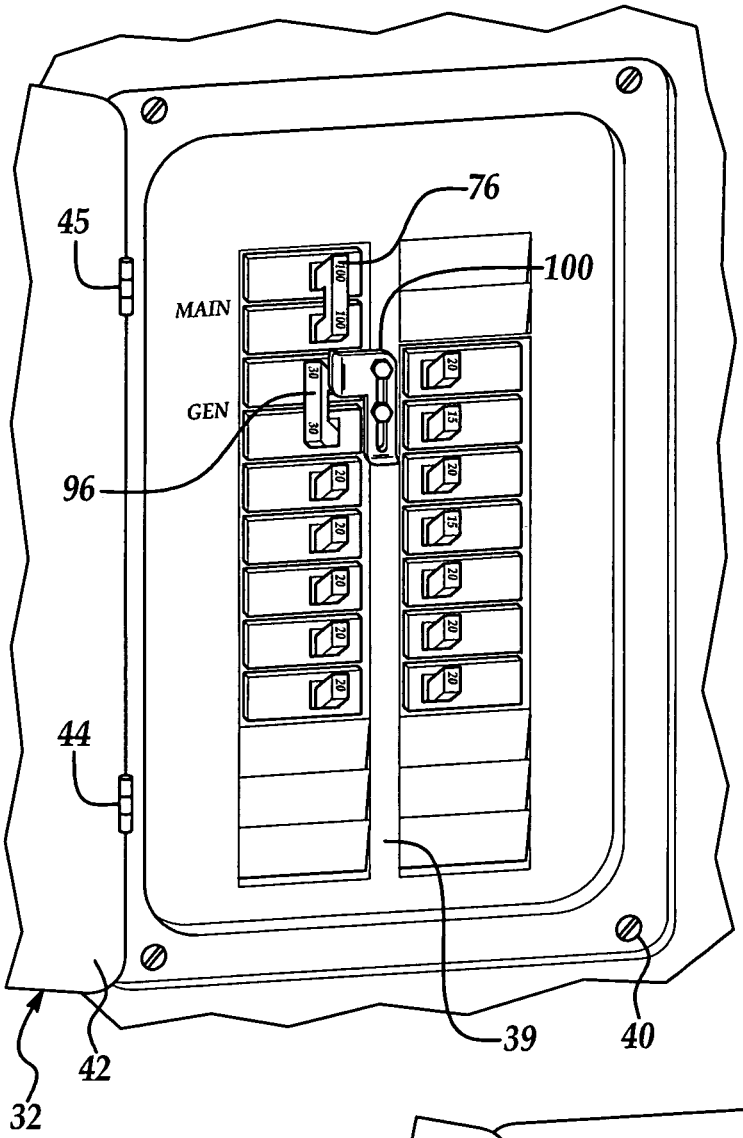
FIG. 3 is a pictorial outer view of the power panel of FIG. 2 illustrating the circuit breakers of the power panel with a control gate according to this invention in a first breaker control position.
Figure 4:
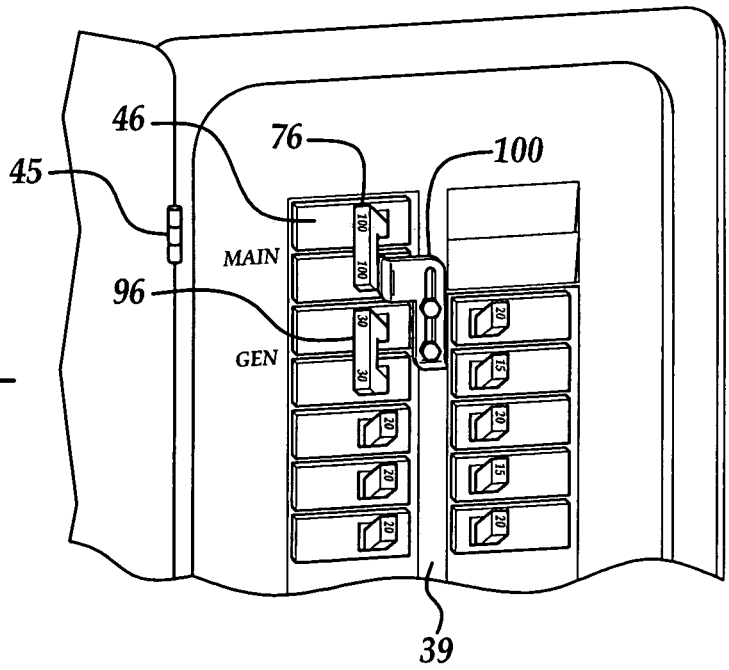
FIG. 4 is a partial view, similar to the view of FIG. 3, illustrating the control gate displaced to a second breaker control position.

The flange 30 presents a flattened surface for securely mounting a face panel assembly 32 thereto (see FIGS. 2–4). The face panel assembly includes a front closure plate 34 having a pair of side-by-side rectilinear access openings or windows 36, 38 formed therein and separated by a centralized vertical strip or mullion 39. The front closure plate 34 is firmly secured to the face flange 30 by retainer screws 40. The face panel assembly 32 further includes a solid access door 42 mounted to the front closure plate 34 by aligned side hinges 44, 45 for swinging movement between (1) a closed and latched position directly over the front closure plate 34 and its access openings and (2) an open position such as shown in FIGS. 3 and 4 uncovering the closure plate. The open position of the door accordingly exposes openings 36, 38 and access to the front portions and manual handles of double pole main circuit breaker 46 and single pole distribution circuit breakers 48, 50 operatively mounted in side-by-side banks within the case of the power panel.

More particularly the back plate 28 of the case has a breaker mounting back pan or mounting bracket 52 secured thereto onto which the main circuit breaker 46 and distribution circuit breakers 48, 50 are detachably mounted. The back pan 52 is an outwardly-facing, open-channel configuration defined by a flattened bottom surface 54 and opposing side walls. The elongated and upper terminal edges of these side walls define laterally-spaced breaker attachment rails 56 and 58.

In the installed position the mounting bracket extends vertically along the back wall of the case and is securely attached thereto. The mounting back pan 52 may be of an electrical insulating material and furnishes support for a pair of vertically extending and flattened bus bars 60 and 62. The bus bars have laterally extending interleaved side fingers 64, 66 that are physically separated and insulated from one another. The bus bar fingers 64, 66 terminate in upwardly-projecting stabs 68, 70 that are aligned in a row and are vertically spaced from one another such as diagrammatically illustrated in FIG. 1. Moreover, a serpentined insulator 72 separates the bus bars, their laterally-extending and interlaced fingers and their associated upwardly extending stabs 68, 70 from one another. The stabs operatively fit into corresponding rear sockets and onto plug on terminals provided in the back portions of the double pole main breaker 46 and the single pole distribution circuit breakers 48, 50 for establishing the electrical connections thereto and to assist in the retention of the breakers on the back pan. Moreover the mullion 39 fits in an elongated rectilinear recess 51 formed by the relief in adjacent end portions of horizontally aligned circuit breakers to further stabilize circuit breaker position in the unit.

The double pole and single pole circuit breakers are ampere rated protective units that control the power flowing through the power panel and through its various distribution circuits in the home, illustrated in FIGS. 1 and 2. The distribution circuits routed from the circuit breakers 48, 50 are diagrammatically illustrated by leads 68*a*, 68*b*, 68*c*, and 70*a*, 70*b*, 70*c*, 70*d*, 70*e*. A wide range of circuit breakers, bus bars and their connections are suitable for service in this invention. For example the circuit breakers, bus bars and related constructions such as those illustrated in U.S. Pat. No. 3,566,318 issued Feb. 23, 1971 to Gelzheiser et al for Circuit Breaker with Improved trip Means; U.S. Pat. No. 5,745,337 issued Apr. 28, 1998 to Reiner for Wire Barrier for Electrical Panel Board and U.S. Pat. No. 5,973,914 issued Oct. 26 to Rose et al for Circuit Breaker Hold-Down which are hereby incorporated by reference may be utilized.

The circuit breakers are configured as thin, block-like, rectilinear units that may be serially installed on the back pan by hooking a retainer foot of each individual circuit breaker on the associated rail 56, 58 of the back pan. The partly installed breaker is then turned about the rail connection until the back socket and associated plug on terminal of the breaker is fully pressed onto the associated back stab 68, 70 of the bus bars linked thereto. The circuit breakers are accordingly tightly secured to the back pan and electrically connected to the associated bus bar. If desired, a hold down screw or other hold down mechanism can be utilized to further secure and stabilize the circuit breakers in installed positions within the case.

The profile of the body of the main circuit breaker 46 is similar to that of the distribution circuit breakers 48 but comprises two conjoined rectilinear casings instead of the single rectilinear casing of the distribution breakers. Each of the conjoined circuit breaker casings however includes its own operating mechanism with an outwardly-projecting handle portion. These projecting handle portions are integrated as illustrated by ganged handle 76 in the drawings thereby uniting the sections of the main circuit breaker as double pole unit. The distributing circuit breakers 48, 50 have a single pole operating handle 78, 80 respectively and are separately operative to control their separate distribution circuits.

Figure 5:
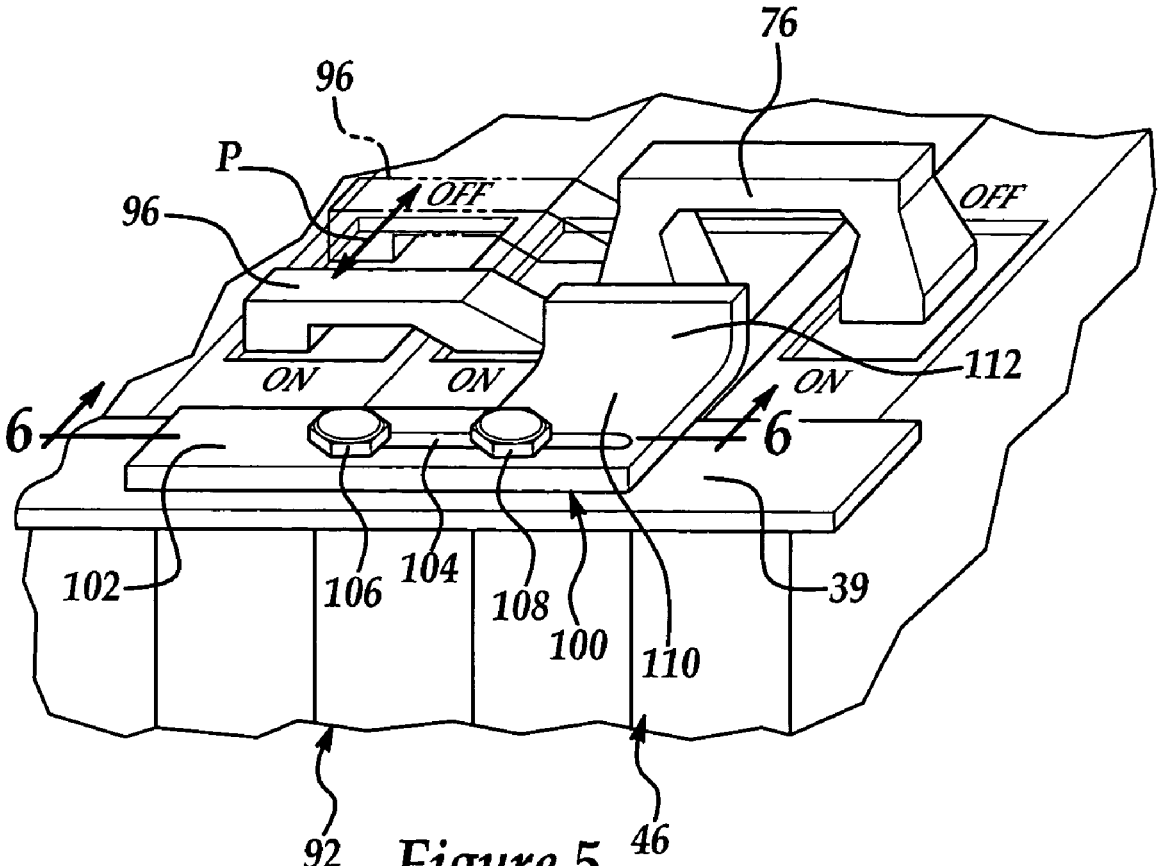
FIG. 5 is an enlarged pictorial view of the control gate in a position blocking the throw of a breaker control arm.
Figure 6:
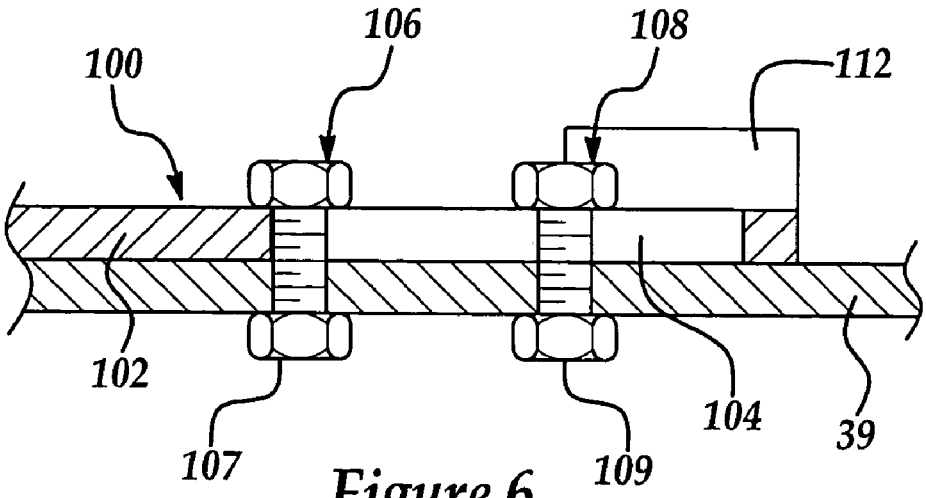
FIG. 6 is a sectional view taken along sight lines 6—6 of FIG. 5.

Moreover the operating handles of the main and distribution breakers project through the openings 36, 38 formed within the front closure plate of the casing and are readily accessible for manual displacement in a horizontal paths such as path "P" in FIG. 5 between "on" and "off" positions to respectively condition the connected breakers for power transmission or for effecting the breaking or interruption of the associated circuit. As is well known in this field, these manual handles are operatively connected to the internal lever systems within the casing that include solenoids or other electrically energizable triggering mechanism which automatically opens the associated circuits in the event of arcing, overloads, or short circuits. Moreover, these circuit breakers are protective units that control the power routed into the case 24 and from the case through various particular distribution circuits in the home such as diagrammatically illustrated by leads 66*a*, 66*b*, 66*c* and 68*a*, 68*b*, 68*c*, 68*d*, 68*e*.

In a circuit breaker arrangement such as in FIG. 1, the consumer can readily check the main and distribution circuits by simply opening the front closure plate 34 of the supply panel as mounted in the home and by observing the positions of the various breaker handles. If a distribution circuit becomes overloaded for example, the associated breaker handle of the distribution circuit breaker will be automatically displaced to an "off" position in which electrical contacts are parted to thereby break the associated distribution circuit. This prevents circuit overheating and possible fire as is well known in this art. This distribution circuit can be readily reinstated by removing the overload and resetting the controlling distribution circuit breaker by moving its manual handle though the "off" position and back to the "on" position.

In the event of a failure of utility supply to the main breaker 46 such as from a defective or "burnt out" transformer 14 or a downed utility power line, power supply for the home will be seriously interrupted and often for an extensive time period so that home occupants quickly realize their dependence on electricity. Failure to power accessories such as furnaces, refrigerators, lighting circuits and water pumps often leave the occupants cold, hungry, uncomfortable and in the dark.

In response to such problems from power outages, this invention provides for new and improved auxiliary electrical power input to the main power panel which is sufficient to keep important distribution circuits running. An auxiliary electric power generator 86 located outside of the building is accordingly directly connected to the household wiring in accordance with this invention in a way which straightforward, economical, safe and convenient. More particularly this auxiliary generator 86 is a portable unit powered by an internal combustion engine that has power feeds 88, 90 that are operatively connected to the two sections of an auxiliary double pole breaker 92. Ground wire 91 is connected to a ground in the box As illustrated best in FIG. 2 the auxiliary breaker 92 is directly installed onto the back pan 52 of the electrical power panel in the blank space 95 (FIG. 1) immediately below the main circuit breaker 46 to provide an auxiliary input.

The double pole auxiliary breaker 92 is like the main breaker 46 but has lower amperage rating such as 60 amps for each section, manually controlled with a ganged manual handle 96. Each section of the auxiliary breaker has a plug on terminal that connects to the respective bus stabs 68 and 70 so that both bus bars are energized by the auxiliary generator when the auxiliary power is being utilized.

Importantly in this invention a double pole circuit breaker gate 100 is operatively mounted on the centralized mullion 39. The gate 100 comprises a main rectilinear body 102 that is flattened and formed with an elongated slot 104 extending a fixed distance along the extent of the main body. A pair of hex headed threaded fasteners 106, 108 that have shanks which extend through slot 104 and bores formed at strategic locations in the mullion 39 and thread into nuts 107 and 109. This slidably secures the gate on the mullion and accurately sets the upper and lower limits of gate travel. This fastening could be accomplished by having the shanks thread into the mullion or by forming the mullion with upstanding bosses to fit into the slot 104. In any event the fasteners can be advanced to tightly secure the gate in any adjusted position as desired or needed.

As illustrated in FIGS. 3,4,5 the gate further comprises a blocker arm 110 integral with the main body 102 that extends laterally to a terminal blocker end portion 112 that contacts the arm portion of either of the double pole breakers. The blocker end portion contacts and blocks movement of the double pole main breaker handle 76 when the bottom of slot 104 engages the shank of the threaded fastener 106 as shown in FIGS. 4 and 5. In this position the main breaker handle is positively blocked and inhibited from being moved to the "on" position. Moreover because of interference with lower handle 96 of the auxiliary breaker, the blocker arm must remain in the main breaker blocking position. When the auxiliary breaker handle is moved to the "on" position shown in FIG. 5, auxiliary or standby power then powers the distribution circuits.

As illustrated in FIG. 3, when the auxiliary breaker arm is moved to the off position, the gate 100 may be shifted downwardly until the top of the slot 104 engages the shank of the threaded fastener 108. The blocker end portion 112 of the blocker arm 110 then contacts the arm portion of the double pole auxiliary breaker handle and prevents it from being moved to an on position. Accordingly the auxiliary breaker is positively inhibited from being closed when the main breaker is closed for transmission of power to the two bus bars.

In a preferred embodiment, the fasteners secured to the mullion project thorough the slot and limit the vertical travel of the gate between (1) a first position (FIG. 3) in which the contact surface 112 of the laterally extending blocker arm 110 contacts the manual operating handle 98 of the auxiliary generator circuit breaker to prevent it from being moved to an "on" and (2) a second position (FIG. 4) in which the contact surface 112 of the laterally extending blocker 110 physically contacts the manual operating handle 76 of the main circuit breaker 46. Consequently only the main breaker or the auxiliary breaker can be moved to a closed position at any one time. Isolation of the powered breaker from the non-powered breaker is thus assured.

If desired the blocker arm 110 can be moved to an intermediate position between the FIGS. 3 and 4 positions so that contact surface 112 will block handles 96 and 76. This prevents either from being placed in the "on" position so that the distribution circuits can be safely serviced.

While specific embodiment of the invention have been shown and described, it will be appreciated by those skilled in the art that various modifications and alternatives to these specifications could be developed in light of the teachings thereof. Accordingly the particularly arrangements disclosed are meant to be illustrative only and not limiting as to the scope of the invention which is to be given the full breath of the claims appended and all equivalents thereof.

What is claimed is:

1. An electrical service panel, comprising:

a breaker box having discrete primary and auxiliary electric power inputs associated therewith and a plurality of separate electric distribution circuits leading from said box;

a first circuit breaker operatively mounted in said box for operatively connecting and disconnecting said primary power input with respect to said distribution circuits;

a second circuit breaker operatively mounted in said box adjacent to said first circuit breaker for operatively connecting and disconnecting said auxiliary power input with respect to said distribution circuits;

a front closure plate for said box having an access opening exposing said first and second circuit breakers, each of said first and second circuit breakers having an external lever arm movable between discrete 'on' and 'off' positions for connecting and disconnecting said associated primary and auxiliary power inputs with respect to said distribution circuits; and a flattened gate having a main body portion with a slot, a blocker arm, and a threaded fastener operatively extending through said slot and into said closure plate for adjustably supporting said gate on said closure plate for movement between at least first and second fixed positions on said closure plate;

wherein said first position only allows said external lever arm of said second circuit breaker to be cycled between said 'on' and 'off' positions, and said second position only allows said external lever arm of said first circuit breaker to be cycled between said 'on' and 'off' positions.

2. The electrical service panel of claim 1, wherein said gate can also be supported at an intermediate position on said closure plate between said first and second positions, said intermediate position blocks said external levers of both said first and second circuit breakers from cycling from said 'off' to said 'on' positions.

3. The electrical service panel of claim 1, wherein said slot and said threaded fastener define a track and a track follower connection between said gate and said cover plate for limiting movement of said gate between said at least first and second fixed positions.

4. A circuit breaker control gate for use with an electrical service panel assembly that at least includes a breaker box, a primary circuit breaker, an auxiliary circuit breaker, and a front closure plate with an access opening, comprising:

an elongated main body portion having an elongated slot;

a blocker arm portion laterally extending from said elongated main body portion and terminating in a blocker end portion; and at least one threaded fastener extending through said elongated slot and into the front closure plate;

wherein said elongated slot and said threaded fastener define a track and track follower connection so that said control gate can be moved alongside an edge of the access opening between: a first position where said blocker end portion prevents only the primary circuit breaker from being moved to an 'on' position, a second position where said blocker end portion prevents only the auxiliary circuit breaker from being moved to an 'on' position, and a third position where said blocker end portion prevents both the primary and auxiliary circuit breakers from being moved to 'on' positions.

* * * * *